US008631851B2

(12) United States Patent
Migues

(10) Patent No.: US 8,631,851 B2
(45) Date of Patent: Jan. 21, 2014

(54) BRACE FOR AWNING ROLLER TUBE

(76) Inventor: Clarence Jules Migues, Tampa, FL (US)

( * ) Notice: Subject to any disclaimer, the term of this patent is extended or adjusted under 35 U.S.C. 154(b) by 394 days.

(21) Appl. No.: 11/702,420

(22) Filed: Feb. 3, 2007

(65) Prior Publication Data

US 2008/0185107 A1 Aug. 7, 2008

(51) Int. Cl.
*E04F 10/00* (2006.01)

(52) U.S. Cl.
USPC ..... 160/67; 160/66; 52/245; 52/836

(58) Field of Classification Search
USPC ..... 160/66.67, 133, 383, 391, 392; 139/89; 52/836, 843, 846, 834
See application file for complete search history.

(56) References Cited

U.S. PATENT DOCUMENTS

| | | | | |
|---|---|---|---|---|
| 1,360,720 | A * | 11/1920 | Brown et al. | 52/838 |
| 2,516,020 | A * | 7/1950 | Reed | 29/897 |
| 2,593,714 | A * | 4/1952 | Robinson | 156/156 |
| 3,461,593 | A * | 8/1969 | Martuch et al. | 43/18.5 |
| 3,789,904 | A * | 2/1974 | Takazawa | 160/120 |
| 4,258,778 | A * | 3/1981 | Upton et al. | 160/383 |
| 4,508,126 | A * | 4/1985 | Everard | 160/67 |
| 4,798,035 | A * | 1/1989 | Mitchell et al. | 52/281 |
| 5,351,736 | A * | 10/1994 | Laffler et al. | 160/66 |
| 5,553,437 | A * | 9/1996 | Navon | 52/837 |
| 6,360,510 | B1 * | 3/2002 | Woodrum et al. | 52/481.1 |
| 6,598,612 | B1 | 7/2003 | Crowe | |
| 6,629,386 | B1 * | 10/2003 | Cornell et al. | 52/36.1 |
| 6,843,301 | B2 * | 1/2005 | Carrillo et al. | 160/310 |
| 7,552,569 | B2 * | 6/2009 | Rotherroe | 52/840 |
| 2010/0050568 | A1 * | 3/2010 | Griffiths | 52/834 |

FOREIGN PATENT DOCUMENTS

GB 1311493 4/1973

OTHER PUBLICATIONS joint. Dictionary.com. Dictionary.com Unabridged (v 1.1). Random House, Inc. http://dictionary.reference.com/browse/joint (accessed: Mar. 24, 2009). definition in action.*

American Psychological Association (APA): mount. (n.d.). Dictionary.com Unabridged. Retrieved Nov. 10, 2013, from Dictionary.com website: http://dictionary.reference.com/browse/mount.*

American Psychological Association (APA): unitary. (n.d.). Collins English Dictionary—Complete & Unabridged 10th Edition. Retrieved Nov. 10, 2013, from Dictionary.com website: http://dictionary.reference.com/browse/unitary.*

* cited by examiner

*Primary Examiner* — Katherine Mitchell
*Assistant Examiner* — Candace L Bradford
(74) *Attorney, Agent, or Firm* — Ronald E. Smith; Smith & Hopen, P.A.

(57) ABSTRACT

Brace devoid of joints or welds for reinforcing a tube, such as the roller tube of an awning, the brace being formed from a pair of elongate metal strips mounted to each other along their respective longitudinal central portions, the edges of each strip forming integral feet at angles with respect to the strip, and the strips extending substantially radially from the mounted central portions to engage the interior of the tube at the feet.

1 Claim, 6 Drawing Sheets

BRACE FOR AWNING ROLLER TUBE

FIELD OF THE INVENTION

The invention relates generally to braces for reinforcing tubes and to tubes reinforced by said braces, and more particularly to a reinforced roller tube for use with extendible awnings of the roll-up type popularly used with recreational vehicles.

BACKGROUND OF THE INVENTION

Awnings of the roll-up type are well-known in the recreational vehicle field for providing shade and cover from inclement weather, and also for providing additional living space adjacent to the vehicle.

Roll-up awnings are also used in a variety of other settings where temporary cover is required. For example, and without limitation, roll-up awnings are used on hotel and shop fronts, and on trailer homes. One edge of the awning is fixed to the vehicle or building and, in the stored position, the other end is wrapped around a spring-loaded roller tube. The awning can be mounted to the roller tube by means of slideways extending longitudinally within the exterior surface of the roller tube. The roller tube can be pivotably supported by arms extending from the vehicle or building, and can be further supported from the ground by poles, or from the vehicle or building by outriggers. The awning is deployed by unrolling the awning from the roller tube against spring resistance, and supporting and locking the unrolled awning in place. Subsequent stowing of the awning onto the roller tube is facilitated by the aforementioned spring-loading.

In the deployed position, the roller tube must support its own weight, the weight of the awning, and the weight of other attachments such as screens or valances. In addition, the roller tube must resist wind forces acting on the awning, and support any additional weight due to precipitation accumulating on the awning. Because the area of awning and the length of the roller tube can be large (roller tubes of 21 feet or more in length are commonly used), the roller tube must be strongly constructed to minimize bowing or bending in use. A common failure mode of roller tubes is for initial bowing to facilitate further accumulation of precipitation on the awning, leading to complete structural failure of the roller tube.

In the past, a long roller tube would sag between its end supports. To mitigate this problem, additional supports can be used; the roller tube can be constructed from strong materials such as extruded aluminum or steel; and/or stiffening inserts can be positioned within the roller tube.

Examples of each of these approaches can be found, for example, in the following patents. U.S. Pat. No. 4,258,778 discloses a roller tube formed from sheet metal, with optional reinforcement provided by inserts or foamed plastic placed within the roller tube; U.S. Pat. No. 4,508,126 discloses partial length stiffeners for a roller tube; U.S. Pat. No. 5,351,736 discloses a roll-formed roller tube with strengthening ridges formed in its surface; and U.S. Pat. No. 6,598,612 B1 discloses an awning having a mansard shape for minimizing the accumulation of precipitation on the awning and aerodynamically reducing the effect of wind on the awning.

Each of the aforementioned approaches suffers from one or more of the following drawbacks: roll-forming long roller tubes from a sheet metal such as steel has proved to be technically difficult; the stiffeners have a low stiffness to weight ratio; the stiffeners have elaborate shapes that are expensive to make; the stiffeners comprise welds or joints that are expensive to form and which may accumulate stresses and fail in use; or additional supports for the awning are required, which may be cumbersome or obstructive.

Notwithstanding the existence of a variety of awning roller tube strengthening devices in the prior art, there is a continuing need for improved means for reinforcing awning roller tubes that can be simply and inexpensively manufactured from commonly available, light weight materials without the need for welding or jointing, and which minimize the risk of roller tube bending or failure from precipitation or wind. The present invention substantially fulfills these needs. All this and more will become apparent to one of ordinary skill upon reading the disclosure, drawings, and claims appended hereto.

SUMMARY OF THE INVENTION

The present invention is directed to a brace for reinforcing a tube, a reinforced tube such as a reinforced roller tube for an awning, and to an awning assembly incorporating said reinforced roller tube. The invention provides an improved brace that is light-weight, resists flexing and twisting, and can be easily and inexpensively manufactured from commonly available sheet materials without the need for welding or jointing.

In a first embodiment, the invention provides a brace for a tube, the brace comprising a pair of mounted, elongate metal strips. Each metal strip comprises a central longitudinal portion, two longitudinal edge portions, and an intermediate longitudinal portion connecting the central portion and each edge portion. The central portions are mounted to each other, for example by rivets. The intermediate portions extend substantially radially from the central portions, and each edge portion forms an angle with the intermediate portion to which it is connected to form a foot for engaging the interior of the tube.

When inserted into a tube, the feet of the brace contact the interior surface of the tube to reinforce the tube. Not to be limited thereby by theory, flexing forces applied to the tube are transferred through one or more of the feet to the mounted central portions of the brace, spreading the force over the contact area of the two central portions, which provides high stiffness. The brace is devoid of joints and welds, which could otherwise accumulate stresses and lead to structural failure. More particularly, the novel brace for reinforcing an elongate hollow tube includes is best described in terms of how it is positioned within the lumen of the elongate hollow tube, and by making reference to the hour hand positions of an analog clock. The top of the elongate hollow tube is defined as the 12:00 position of said analog clock and the bottom of the elongate hollow tube is defined as the 6:00 position. A first metal strip has an elongate central park. A first medial part has a first end connected to a first end of the elongate central part and extends therefrom at an obtuse angle. A first tube-abutting part is connected to a second end of the first medial part and disposed in abutting relation to an inner sidewall of the tube at about the 10:30 position. A second medial part has a first end connected to a second end of the elongate central part and extends therefrom at an obtuse angle. A second tube-abutting part is connected to a second end of the second medial part and disposed in abutting relation to an inner sidewall of the tube at about the 1:30 position. The novel brace further includes a second metal strip having an elongate central part. A first medial part has a first end connected to a first end of the elongate central part of the second metal strip and extends therefrom at an obtuse angle. A first tube-abutting part is connected to a second end of the first medial part of the second metal strip and disposed in abutting relation to an inner sidewall of the tube at about the 7:30 position. A second medial part has a first end connected to a second end of the elongate central part of the second metal strip and extends therefrom at an obtuse angle. A second tube-abutting part is connected to a second end of the second medial part of the second metal strip and disposed in abutting relation to an inner sidewall of the tube at about the 4:30 position. The respective central parts of the first and second metal strips are disposed in abutting relation to one another and are secured to one another. The elongate hollow tube is adapted to support a load along its extent so that the top of the tube is subjected to compression and the bottom of the tube is subjected to tension. The respective central parts of the first and second metal strips lie in a plane that is normal to the top and bottom of the tube. The first and second tube-abutting parts of the first metal strip are disposed on opposite sides of the top of the tube at said 1:30 and 10:30 positions, respectively, and the first and second tube-abutting parts of the second metal strip are disposed on opposite sides of the bottom of the tube at said 7:30 and 4:30 positions, respectively. Loads appearing on the first and second tube-abutting parts of the first metal strip are therefore transferred to opposite ends of the central part of the first metal strip by the first and second medial parts of the first metal strip and loads appearing on the first and second tube-abutting parts of the second metal strip are transferred to opposite ends of the central part of the second metal strip by the first and second medial parts of the second metal strip. All loads appearing on the tube are therefore transferred to the first and second central parts of the first and second metal strips, respectively.

In a second embodiment, the invention provides a reinforced roller tube for an awning, the roller tube comprising a brace according to the first embodiment disposed within at least a central portion of the roller tube.

In a third embodiment, the invention provides an improved awning assembly, the awning assembly comprising a reinforced roller tube according to the second embodiment, and further comprising an awning having first and second ends, the first end being attachable to a wall or support, the second end being attached to the roller tube, and the awning being rollable around the roller tube.

It is therefore an object of the present invention to provide an improved brace exhibiting a high stiffness to weight ratio for reinforcing a tube, wherein the cross-sectional shape of the tube is not particularly limited, and can include, for example, circular, elliptical, square, hexagonal, or octagonal cross-sections.

It is a further object of the invention to provide a brace for a tube that can be simply and inexpensively manufactured from commonly available, light-weight sheet materials, without the need for welding or jointing.

It is a further object of the invention to provide a reinforced roller tube for use with awnings that minimizes the risk of roller tube bending or failure from the action of precipitation or wind, without unduly adding to the weight of the roller tube.

It is a further object of the invention to provide an improved awning assembly for use on hotels, shop fronts, recreational vehicles, and mobile homes, which resists bending and/or collapse due to the action of wind or accumulation of precipitation on the awning, without unduly adding to the weight, complexity, or cost of the awning assembly.

It is yet a further object of the invention to provide a brace that can be used to reinforce pre-existing tubes, such as existing roller tubes, by subsequent insertion therein of a brace according to the first embodiment.

BRIEF DESCRIPTION OF THE DRAWINGS

These and other features, aspects, and advantages of the present invention will become better understood with regard to the following description, appended claims, and accompanying drawings where:

DETAILED DESCRIPTION

Figure 1:
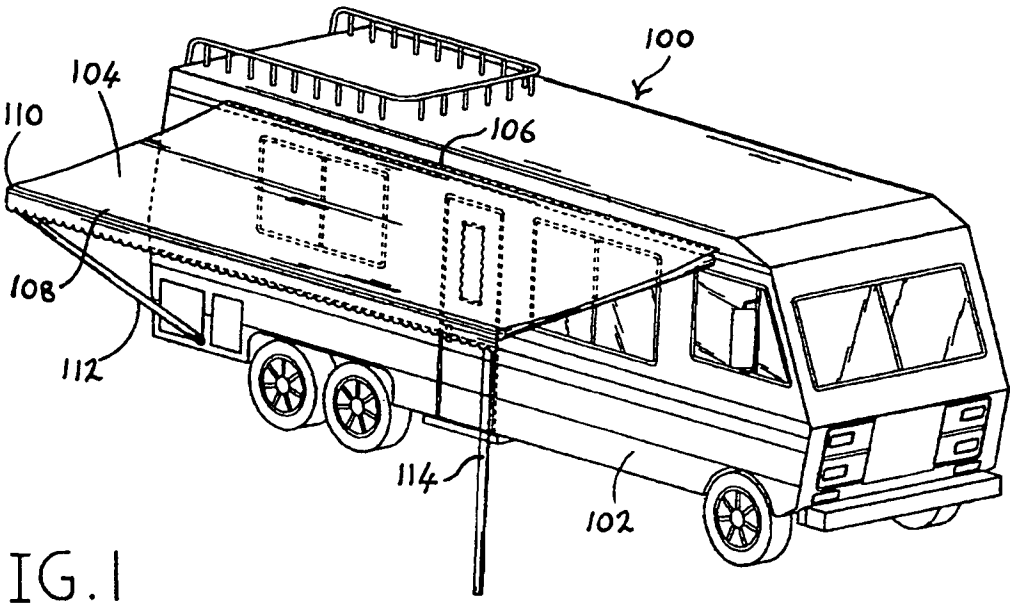
FIG. 1 depicts a recreational vehicle incorporating an awning assembly according to the present invention.

Certain exemplary but non-limiting embodiments of the present invention are now described for illustrative purposes with reference to the attached drawings.

The present invention is directed to a brace for reinforcing a tube, a reinforced tube such as a roller tube for an awning, and to an awning assembly incorporating said reinforced roller tube. In the detailed description that follows, the respective central parts of the first and second metal strips 402 and 404 are referred to collectively by the reference numeral 406 and are referred to as central longitudinal portions. In the claims that follow the detailed description, said parts are referred to as the central part of the first metal strip and the central part of the second metal strip, respectively. Medial parts 410, 412 are referred to in the detailed description as intermediate portions and in the claims as the first and second medial parts of the first metal strip. The detailed description provides no reference numerals for the intermediate portions of the second metal strips but in the claims said parts are referred to as the first and second medial parts of the second metal strip. Feet 506 and 508 are referred to in the claims as a first rube-abutting part and a second tube-abutting part of said first metal strip. Feet 510 and 512 are referred to in the claims as a first rube-abutting part and a second tube-abutting part of said second metal strip, respectively.

Referring now to FIG. 1, there is shown a recreational vehicle 100 with wall 102, the vehicle equipped with an awning 104, such as a canvas or vinyl awning, with which the reinforced roller bar 110 of the present invention is particularly suited. The awning 104 comprises a first end 106 that is secured to the wall 102 of the vehicle 100, and a second end 108 secured to the roller tube 110. In an extended state, the awning 104 and roller tube 110 are supported by two or more poles or outriggers, such as one or more outriggers 112 supported against wall 102, or one or more poles 114 supported by the ground. In typical embodiments, the awning 104 can extend about eight feet from the vehicle 100 and the awning 104 can extend twenty or more feet along the vehicle 100. In the past, awnings have typically shown some degree of sag at the roller tube 110, which can be exacerbated by precipitation or debris collecting in the awning 104 and/or by wind action on the awning 104, which can lead to structural failure of the roller tube 110.

Figure 2:
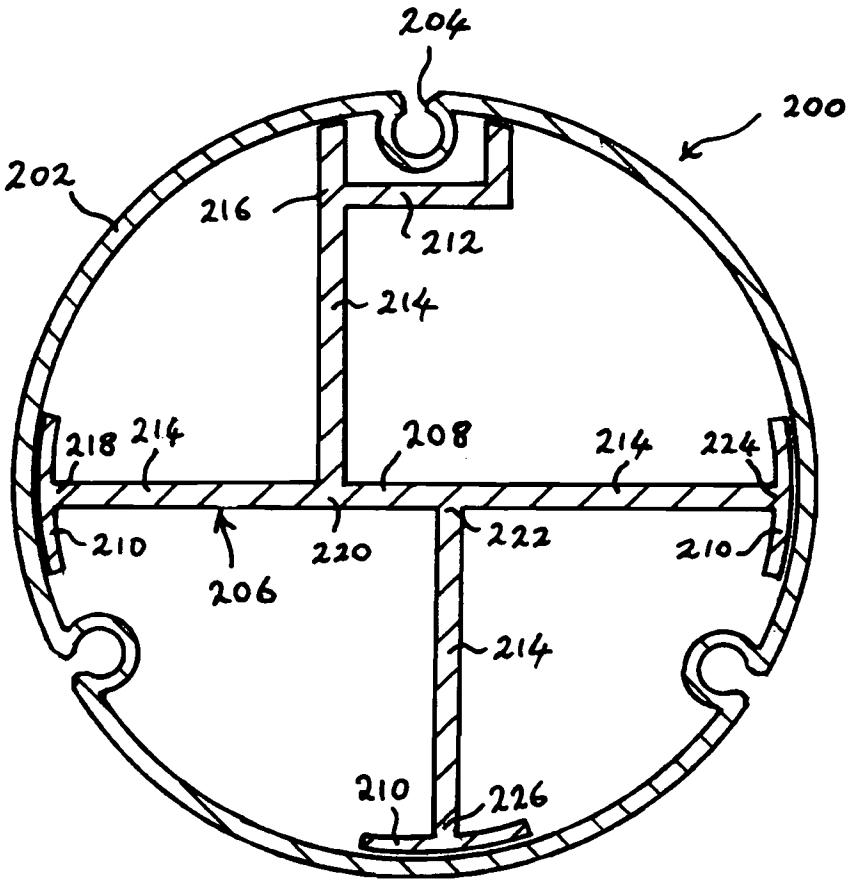
PRIOR ART FIG. 2
FIG. 2 shows a transverse sectional view of reinforced roller tube according to the prior art.

Referring now to FIG. 2, a reinforced roller tube 200 of the prior art comprising roller tube 202 in combination with a brace 206, and is shown in cross-section. Roller tube 202 can, for example, be an extruded metallic tube, the outer surface thereof optionally comprising a plurality of slideways 204 extending longitudinally along the roller tube 202 for mounting the awning, a screen, or a valance to the roller tube 202. The brace 206 is disposed within at least a central portion of the roller tube 202. The prior art brace of FIG. 2 has an offset X cross-section 208 comprising four struts 214 extending approximately radially. Each strut 214 terminates adjacent the inner surface of the roller tube 202 in a foot 210, 212. In the embodiment of FIG. 2, three simple feet 210, and a foot in the form of an internal receiving channel 212 for engaging slideway 204, are provided. Bending moments applied to the roller tube 202 are transferred to the brace 206 via the integral feet 210, 212 whereby the rigidity of the brace 206 opposes bending of the roller tube 202. The cross-sectional dimensions of the brace 206 are selected so that the feet 210, 212 are adjacent the inner wall of the roller tube in the assembled state, and so that the brace can be inserted into the roller tube without binding.

In the prior art brace 206 of FIG. 2, a plurality of joints are present 216, 218, 220, 222, 224, 226. Bending moments applied to the brace can result in accumulation of stresses at the joints, and, in the extreme case, structural failure.

As used herein, the term "joint" refers to an integral tee structure in metal, whether formed by welding, extrusion, molding, or the like, and the term "joint" is therefore distinct to and different from the mounting of two sheets of metal by fasteners.

Figure 3:
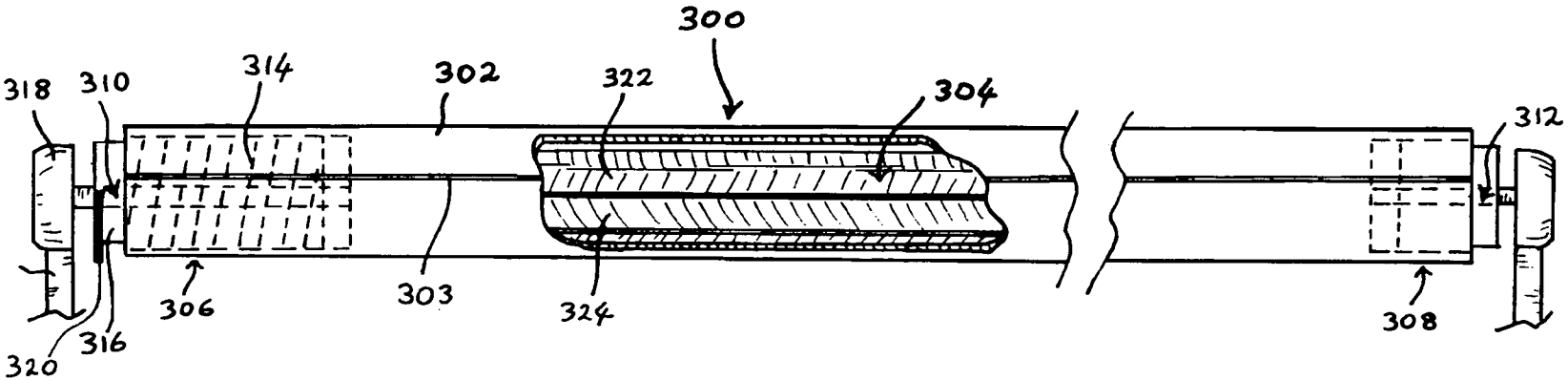
FIG. 3 shows an isometric view, partially cut away, of an embodiment of a reinforced roller tube according to the present invention.

As shown in FIG. 3, a reinforced roller tube according to the present invention is shown. Reinforced roller tube 300 comprises a roller tube 302 and a brace 304 disposed within a central portion of the roller tube. Optionally, roller tube 302 comprises one or more slideways 303 such as recessed structures comprising longitudinal grooves extending parallel to the axis of the roller tube and integrally formed within the surface of the roller tube 302 and adapted to retain the edge of an awning, a valance, a screen, or the like. The roller tube 302 can be formed of any sufficiently rigid material, such as extruded aluminum, roll-formed steel sheet, or steel pipe. The dimensions of the roller tube 302 are not particularly limited. For example, roller tubes of from about two to twenty-five or more feet in length are known in the art, and the diameter of a roller tube can be from about one inch to more than six inches. Most preferably, the diameter of the roller tube is about two to three inches in diameter.

At one or both of a first 306 and second 308 end of the roller tube, optional means 310, 312 are provided for rotationally coupling the roller tube 302 to its support and preferably for providing spring resistance to unrolling of the awning and assistance in its re-rolling. Such means are well-known in the art and typically comprise at least a spring assembly 314, head casing 316, mounts 318 for attaching the roller tube to its support, and a locking means 320 such as a locking pin for holding the awning in an extended configuration.

The central portion of the roller tube 302 comprises one or more braces 304. As used herein, the central portion of the roller tube is any portion of the roller tube excluding the optional means 310, 312 located at a first 306 and second 308 end of the tube. For example, in a preferred embodiment, brace 304 can be disposed within the central ten feet of a fourteen foot roller tube.

The brace 304 comprises a first 322 and a second 324 elongate metal strip mounted to each other. The metal strips can formed from an aluminum or steel sheet, and can optionally further comprise a coating such as galvanized coating. The longitudinal dimension of the strips is selected according to the length of the required brace. The width of the strip is selected to be commensurate with the inner diameter of the roller tube, when the strip is in the configuration of a brace according to the invention, so that the brace can be inserted into the roller tube without binding, and the feet of the brace can contact or be adjacent to the inner surface of the roller tube.

Figure 4:
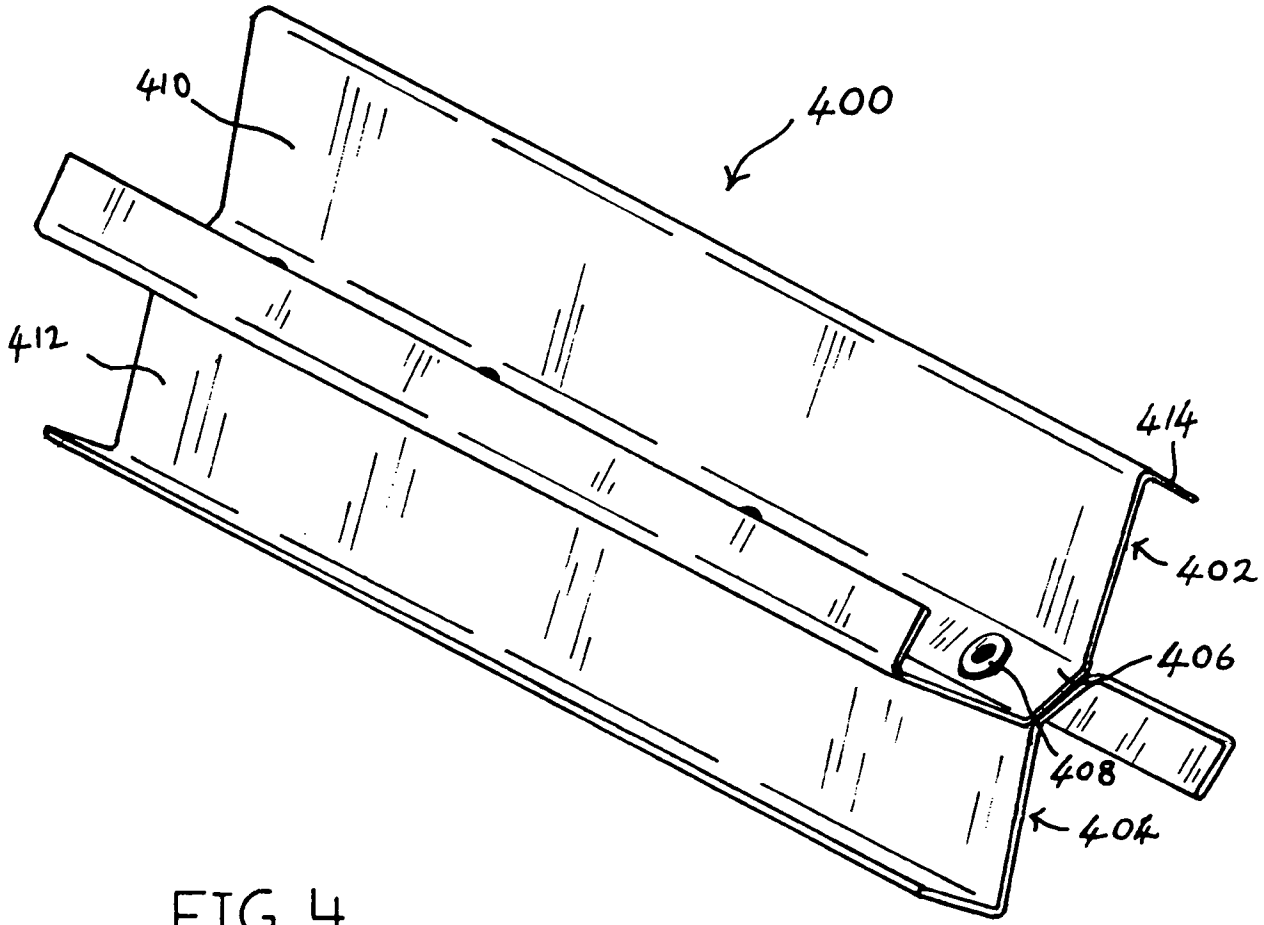
FIG. 4 shows an isometric view of a brace according to the present invention.

Referring now to FIG. 4, a brace 400 according to the present invention is shown in further detail. First 402 and second metal strip 404 each comprise a central longitudinal portion 406 extending medially and substantially the length of each strip. The two central longitudinal portions are mounted to each other by fasteners 408. Any suitable fastener or fastening means now or subsequently known in the art can be used to mount the strips. For example, and without limitation, rivets, bolts, screws, adhesive, spot welding, clips, or a combination thereof can be used. It will be readily appreciated by those of ordinary skill that rigidity of the brace does not require that the strips be mounted at every point along the central longitudinal portions 406, and that substantial rigidity can be obtained using spaced apart fasteners 408. In a preferred embodiment of a brace of about ten feet in length, rivets are spaced apart at intervals of about 12 to 18 inches.

Without being thereby limited by theory, the brace of the present invention is substantially stiff in part because bending moments applied to the tube are distributed over the common surface of the mounted central longitudinal portions 406. Thus, in use, the stress upon the fasteners 408 is low.

The width of central longitudinal portion 406 is selected according to the width required by fasteners 408 and also to permit the intermediate portions 410, 412 to extend substantially radially from central longitudinal portions 406 towards the inner surface of the tube. In preferred embodiments, the width of central longitudinal portion 406 is approximately 20% of the inner diameter of the tube.

The longitudinal outer edge 414 of each intermediate portion 410, 412 forms an angle with the intermediate portion to which it is contiguous to form a foot for contacting the inner surface of the tube. The feet can be oriented in a clockwise or anti-clockwise direction with respect to a transverse section of the brace, or a single brace can comprise a combination of clockwise and anti-clockwise-oriented feet. The location of the feet is selected to engage the inner wall of the tube, whereby the brace can be freely inserted into the tube without binding, and bending moments applied to the tube are transferred to the brace via the feet. As used herein, the term "engage" encompasses feet that are proximal to or in contact with the inner surface of the tube. It is not required that the feet be mounted or connected to the inner surface of the tube.

Figure 5:
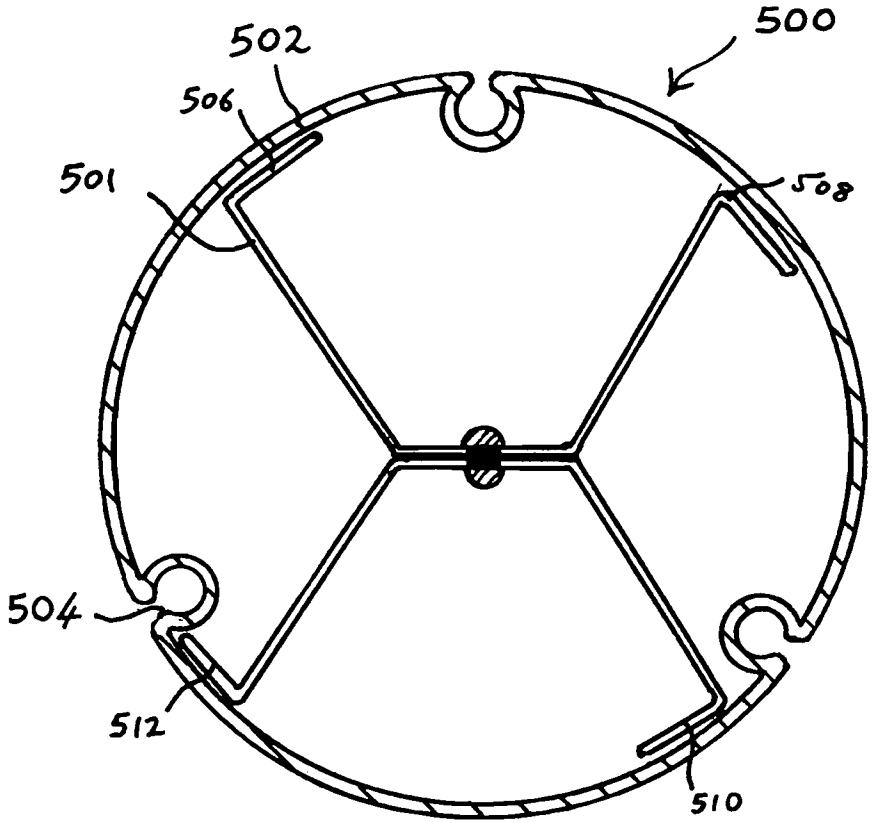
FIG. 5 shows a transverse sectional view of a reinforced roller tube according to the present invention.

Referring now to FIG. 5, a transverse section of a reinforced roller tube 500 according to the present invention comprising brace 501 inserted into a roller tube 502 is shown. The feet 506, 508, 510, 512 are preferably positioned with respect to the inner surface of roller tube 502 to avoid slideways 504 or like feature of the tube. The width of the feet 506, 508, 510, 512 is not particularly limited. In preferred embodiments, the width of the feet is approximately 20% of the inner diameter of the tube.

Figure 6:
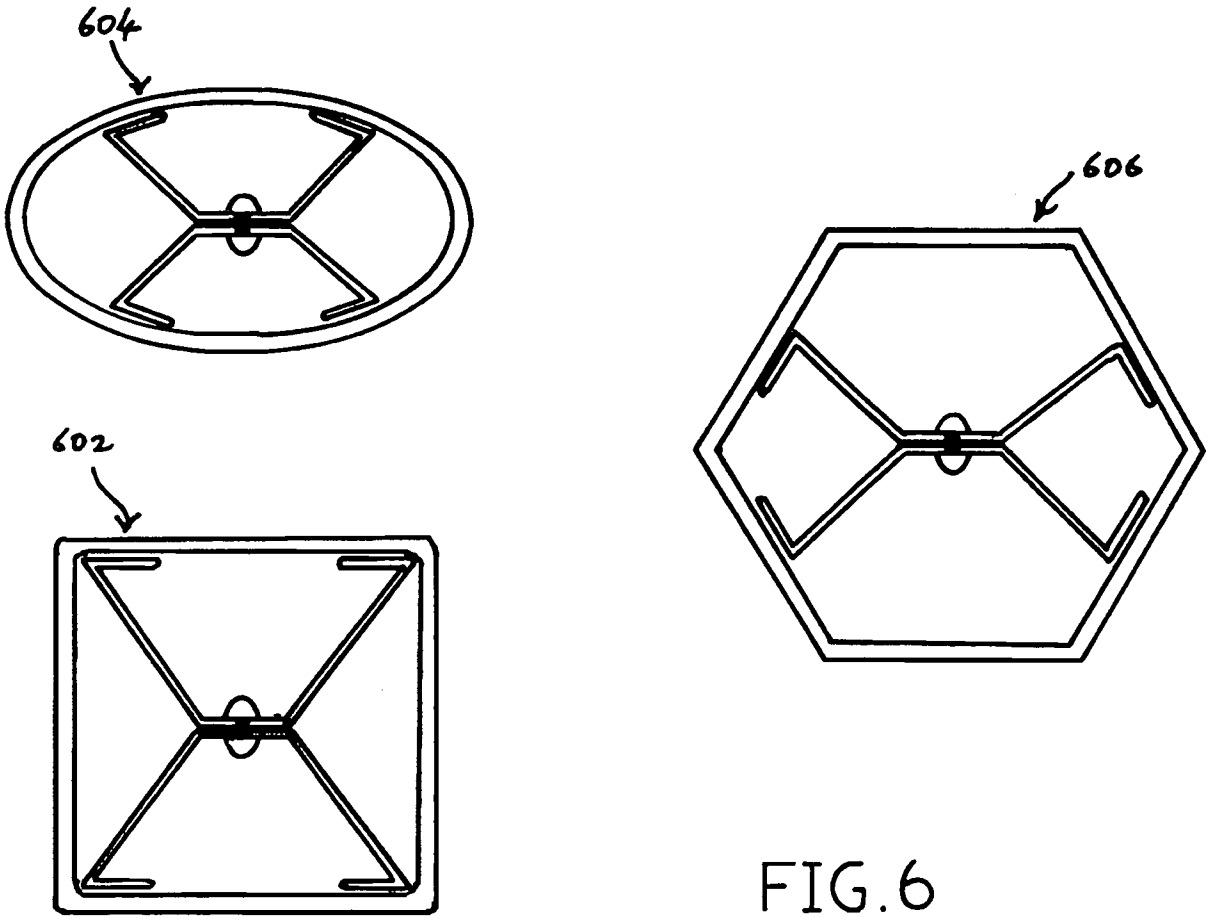
FIG. 6 shows transverse sectional views of several embodiments of reinforced tubes according to the present invention, the tubes having different cross-sectional shapes.

The brace of the present invention is not limited to tubes of circular cross-section. Referring now to FIG. 6, reinforced tubes according to the present invention are illustrated having square 602, oval 604, and hexagonal 606 cross-sections. It will be readily appreciated that the physical principles upon which the present brace is based permit the brace to be scaled in size for a wide range of tube sizes. Thus, for example and without limitation, very small (less than one-half inch diameter) and very large (more than one foot in diameter) tubes can be reinforced by braces contemplated as falling within the scope of the present invention. In like manner, the brace according to the present invention is not limited in its application to the roller tube applications by which the present invention has been illustrated, but instead can be used in a wide variety of unrelated applications in which a reinforced tube is desired.

In use, a brace according to the present invention is inserted into at least a portion of a tube or roller tube to achieve reinforcement. For example, a brace can be inserted into the central one-third of a tube, or a plurality of shorter braces can be used, or the full length of a tube excluding end fittings, if any, can be reinforced.

The device of the present invention provides a number of advantages over the prior art. The brace exhibits a high stiffness to weight ratio for reinforcing tube of essentially any desired cross-section. The brace can be simply and inexpensively manufactured from commonly available, light-weight sheet materials, such as aluminum or steel sheet, without the need for welding or jointing. The brace can be used in a wide variety of applications, including its use to reinforce the roller tube of an awning wherein it minimizes the risk of roller tube bending or failure from the action of precipitation or wind without unduly adding to the weight of the roller tube. Further, the brace of the present invention is readily adaptable for retro-fitting for reinforcement of pre-existing tubes.

Although the present invention has been described in considerable detail with reference to certain preferred versions thereof, other versions are possible and can be envisaged within the scope and spirit of the present invention. Therefore, the spirit and scope of the appended claims should not be limited to the description of the preferred versions contained herein.

Now that the invention has been described:

What is claimed is:

1. A brace for reinforcing an elongate, substantially horizontally disposed hollow cylindrical tube, comprising:

said tube having a top defined as a 12:00 position of an analog clock hour hand when said tube is viewed in end view;

said tube having a bottom defined as a 6:00 position of said analog clock hour hand when said tube is viewed in end view;

a first metal strip having a straight elongate central part of planar construction disposed in a substantially horizontal plane when said top and bottom of said tube are positioned in a substantially vertical plane, said straight elongate central part of planar construction of said first metal strip being bisected by said substantially vertical plane;

said straight elongate central part of said first metal strip having a length less than a diameter of said tube, said length being less than half of said diameter;

a first medial part of said first metal strip having a first end connected to a first end of said elongate straight central part of planar construction and extending therefrom at an obtuse angle;

a tube-abutting part connected to a second end of said first medial part of said first metal strip and disposed in abutting relation to an inner sidewall of said tube at about a 10:30 position;

a second medial part of said first metal strip having a first end connected to a second end of said elongate straight central part of planar construction and extending therefrom at an obtuse angle;

a tube-abutting part connected to a second end of said second medial part of said first metal strip and disposed in abutting relation to an inner sidewall of said tube at about a 1:30 position;

a second metal strip having an elongate straight central part of planar construction disposed in a substantially horizontal plane when said top and bottom of said tube are positioned in said substantially vertical plane, said elongate straight central part of planar construction of said second metal strip being bisected by said substantially vertical plane;

said straight elongate central part of said second metal strip having a length equal to the length of said straight elongate central part of said first metal strip and being positioned in abutting relation to said straight elongate central part of said first metal strip, said respective straight elongate central parts of said first and second metal strips abutting one another along their respective lengths;

a first medial part of said second metal strip having a first end connected to a first end of said elongate straight central part of planar construction of said second metal strip and extending therefrom at an obtuse angle;

a tube-abutting part connected to a second end of said first medial part of said second metal strip and disposed in abutting relation to an inner sidewall of said tube at about a 7:30 position;

a second medial part of said second metal strip having a first end connected to a second end of said elongate straight central part of planar construction of said second metal strip and extending therefrom at an obtuse angle;

a tube-abutting part connected to a second end of said second medial part of said second metal strip and disposed in abutting relation to an inner sidewall of said tube at about a 4:30 position;

said respective elongate straight central parts of planar construction of said first and second metal strips being secured to one another in permanent, abutting relation to one another in said substantially horizontal plane;

said respective elongate straight central parts being positioned in said abutting relation on opposite sides of an imaginary line that marks a diameter of said tube;

said tube-abutting parts of said first metal strip being disposed on opposite sides of said top of said tube;

said tube-abutting parts of said second metal strip being disposed on opposite sides of said bottom of said tube;

whereby loads appearing on said tube-abutting parts of said first metal strip are transferred to opposite ends of said elongate straight central part of planar construction of said first metal strip by said first and second medial parts of said first metal strip;

whereby loads appearing on said tube-abutting parts of said second metal strip are transferred to opposite ends of said elongate straight central part of planar construction of said second metal strip by said first and second medial parts of said second metal strip;

whereby all loads appearing on said tube are transferred to said first and second elongate straight central parts of said first and second metal strips, respectively; and whereby said top of said tube is subjected to compression and said bottom of said tube is subjected to tension.

* * * * *